United States Patent [19]

Nitta

[11] 4,300,222

[45] Nov. 10, 1981

[54] ELECTRONIC TIMEPIECE

[75] Inventor: Tatsuo Nitta, Tokorozawa, Japan

[73] Assignee: Citizen Watch Co., Ltd., Tokyo, Japan

[21] Appl. No.: 856,752

[22] Filed: Dec. 1, 1977

[30] Foreign Application Priority Data

Dec. 3, 1976 [JP] Japan ..... 51/145332

[51] Int. Cl.[3] ..... G04B 19/24

[52] U.S. Cl. ..... 368/37; 368/76; 368/220

[58] Field of Search ..... 58/4 A, 23 D, 41 A, 58/58, 125 R, 50 R, 85.5; 318/696, 685; 310/49 R, 83, 163, 164; 368/28, 37, 76, 220

[56] References Cited

U.S. PATENT DOCUMENTS

| | | | |
|---|---|---|---|
| 3,662,534 | 5/1972 | Colomb | 58/58 |
| 3,732,687 | 5/1973 | Miyasaka et al. | 58/58 |
| 3,775,966 | 12/1973 | Matsuura | 58/58 |
| 3,779,000 | 12/1973 | Schmid | 58/58 |
| 3,815,351 | 6/1974 | Vovelle | 58/4 A |
| 3,945,191 | 3/1976 | van Berkum | 58/4 A |
| 3,961,472 | 6/1976 | Riehl | 58/58 |
| 4,112,671 | 9/1978 | Kato et al. | 58/23 D |
| 4,175,372 | 11/1979 | Tamaru et al. | 368/28 |

FOREIGN PATENT DOCUMENTS

| | | | |
|---|---|---|---|
| 2001187 | 1/1979 | United Kingdom | 58/23 D |
| 1540555 | 2/1979 | United Kingdom | 58/23 D |
| 2005876 | 4/1979 | United Kingdom | 58/4 A |

*Primary Examiner*—J. V. Truhe
*Assistant Examiner*—Forester W. Isen

[57] ABSTRACT

An electronic timepiece equipped with calendar display means adapted to be driven by a drive motor means provided independently of a drive motor means adapted for driving time indicating hands. The drive motor means for driving the calendar display means is driven by a drive system which comprises a calendar memory circuit responsive to a reference signal, i.e., a 00:00 AM signal indicative of midnight, to update the content of the calendar memory circuit, a drive signal setting circuit coupled to said calendar memory circuit and generating a calendar information signal in response to the content of said calendar memory circuit, and a driver circuit responsive to said calendar information signal to generate a drive signal for energizing said drive motor means for driving said calendar display means.

5 Claims, 20 Drawing Figures

TIME AND CALENDAR SETTING MECHANISM
10
00:00AM SIGNAL
41
41a
41b
DATES COUNTER
42
43
43a
43b
MONTHS COUNTER
44
45
45a
45b
YEARS COUNTER
46
MONTH END DISCRIMINATION CIRCUIT
47
47a
47b
47c
MONTHS DISCRIMINATION CIRCUIT
48
48a
48b
LEAP YEAR DISCRIMINATION CIRCUIT
49
49a
40
40a
40b
50
50a
50b
50c

| $Q_A$ | $Q_B$ | $Q_C$ | |
|---|---|---|---|
| H | H | H | |
| L | H | H | ← 5129 |
| H | L | H | ← 5130 |
| L | L | H | ← 5131 |
| H | H | L | |
| L | H | L | |
| H | L | L | |
| L | L | L | |

| $Q_1$ | $Q_2$ | $Q_3$ | $Q_4$ | $Q_5$ |
|---|---|---|---|---|
| L | H | H | H | H |
| H | L | H | H | H |
| L | L | H | H | H |
| H | H | L | H | H |
| L | H | L | H | H |
| H | L | L | H | H |
| L | L | L | H | H |
| H | H | H | L | H |
| L | H | H | L | H |
| H | L | H | L | H |
| L | L | H | L | H |
| H | H | L | L | H |
| L | H | L | L | H |
| H | L | L | L | H |
| L | L | L | L | H |
| H | H | H | H | L |

← 6029

| $Q_1$ | $Q_2$ | $Q_3$ | $Q_4$ | $Q_5$ | |
|---|---|---|---|---|---|
| L | H | H | H | L | |
| H | L | H | H | L | |
| L | L | H | H | L | |
| H | H | L | H | L | ← 6030 |
| L | H | L | H | L | |
| H | L | L | H | L | |
| L | L | L | H | L | |
| H | H | H | L | L | ← 6031 |
| L | H | H | L | L | |
| H | L | H | L | L | |
| L | L | H | L | L | |
| H | H | L | L | L | ← 6032 |
| L | H | L | L | L | |
| H | L | L | L | L | |
| L | L | L | L | L | |
| H | H | H | H | H | |

71
710
711
712
84a
84b
84
841
842
83e
83
83d
81
835a
834c
834d
835b
81c
81d
814b
814c
82
703a
702a
834b
834e
810b
833
832
831
813
812
811
834a
814a
830a
830b
83b
83a
810a
81b
81a
58f
83c
59
836
80

ELECTRONIC TIMEPIECE

BACKGROUND OF THE INVENTION

This invention relates to electronic timepieces equipped with calendar display means and, more particularly, to a drive system for a calendar display means in an electronic timepiece.

In conventional electronic timepiece equipped with calendar display means, dates dial and days dial are usually driven by a drive means commonly used for driving a time indicator mechanism including time indicating hands. Therefore, it is necessary to manually increment, by means of a crown or the like, solely the dates wheel coupled to the dates dial on the last day of a short month. Another drawback is encountered in the prior art electronic timepiece of the type mentioned above in that the incrementation of the dates dial and days dial is accomplished by means of the dates wheel which makes one revolution per day; hence it is not possible to increment both the dates and days dials immediately after midnight.

SUMMARY OF THE INVENTION

It is, therefore, an object of the present invention to provide an improved electronic timepiece which can overcomes the shortcomings encountered in the prior art.

It is another object of the present invention to provide an electronic timepiece equipped with a calendar display means, in which the calendar display means are automatically advanced immediately after midnight whereby an end of the month correction is unnecessary even on the last day of a short month or a long month.

It is still another object of the invention to provide an electronic timepiece equipped with a calendar display means, in which dates and days dials are driven by a drive means independent of a drive means adapted for driving time indicating hands.

It is a further object of the present invention to provide an electronic timepiece equipped with a calendar display means adapted to by driven by a simple mechanism which is highly reliable in operation.

BRIEF DESCRIPTION OF THE DRAWINGS

These and other objects, features and advantages of the present invention will become more apparent from the foregoing description when taken in conjunction with the accompanying drawings, in which.

DESCRIPTION OF THE PREFERRED EMBODIMENTS

Figure 1:
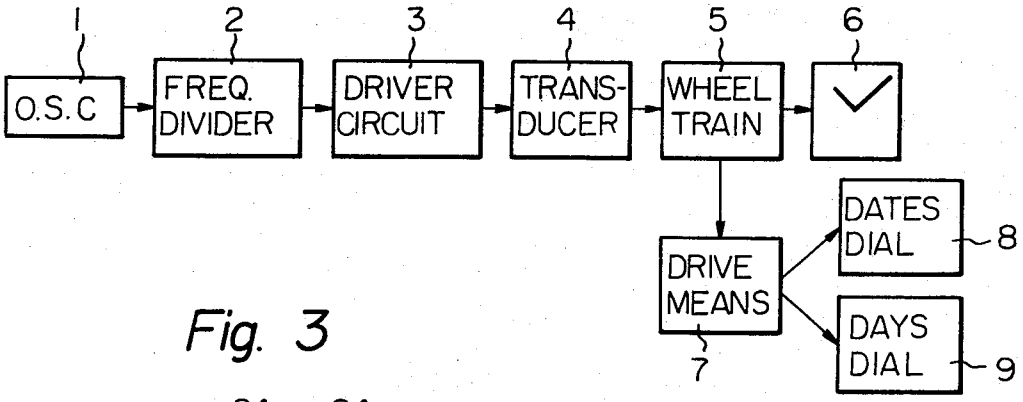
FIG. 1 is a block wiring diagram showing a conventional electronic timepiece.

Referring to FIG. 1, there is shown a block wiring diagram of a conventional electronic timepiece equipped with a calendar display means. The timepiece generally comprises a frequency standard such as a crystal controlled oscillator 1 for generating a relatively high frequency standard signal, a frequency divider 2, a driver circuit 3, an electro-mechanical transducer 4 (such as a stepping motor), an hours and minutes hand wheel train 5, a time indicator means 6, a dates and days of the week drive means 7, a dates dial 8 and a days dial 9. In operation, a relatively high standard signal produced by oscillator 1 is divided by frequency divider 2 down to a low frequency signal suitable for driving the driver circuit 3 which in turn drive the transducer 4. The hours and minutes hand wheel train 5, responsive to the transducer, properly increments the hours, minutes and seconds hands of the time indicator 6 and drive the dates dial 8 and days dial 9 through the dates and days of the week drive means 7 which is composed of a dates wheel or the like. A defect in this system was that the dates dial and days dial were driven simultaneously by the common drive means 7 so that it was necessary to manually increment, by means of a crown or the like, solely the dates wheel 9 on the last day of a short month. Another defect resided in the fact that the incrementation of the dates dial 8 and days dial 9 was accomplished by means of the dates wheel (not shown) which made one complete revolution per day; hence, it was not impossible to increment both the date and day dials immediately after midnight.

The present invention seeks to eliminate these defects through the provision of a calendar display dial drive mechanism in which an end of the month correction is unnecessary even on the last day of a short or long month, this being accomplished by utilizing two separate driving motors, one for driving the hours, minutes and seconds hands and the other for driving the calendar display dials, the driving operation thus being divided between the hours, minutes and seconds hands on the one hand of the calendar display dials, i.e., the dates dial 8 and days of the week dial 9, on the other.

A more detailed description of the invention will now be had with reference to the accompanying drawings.

Figure 2:
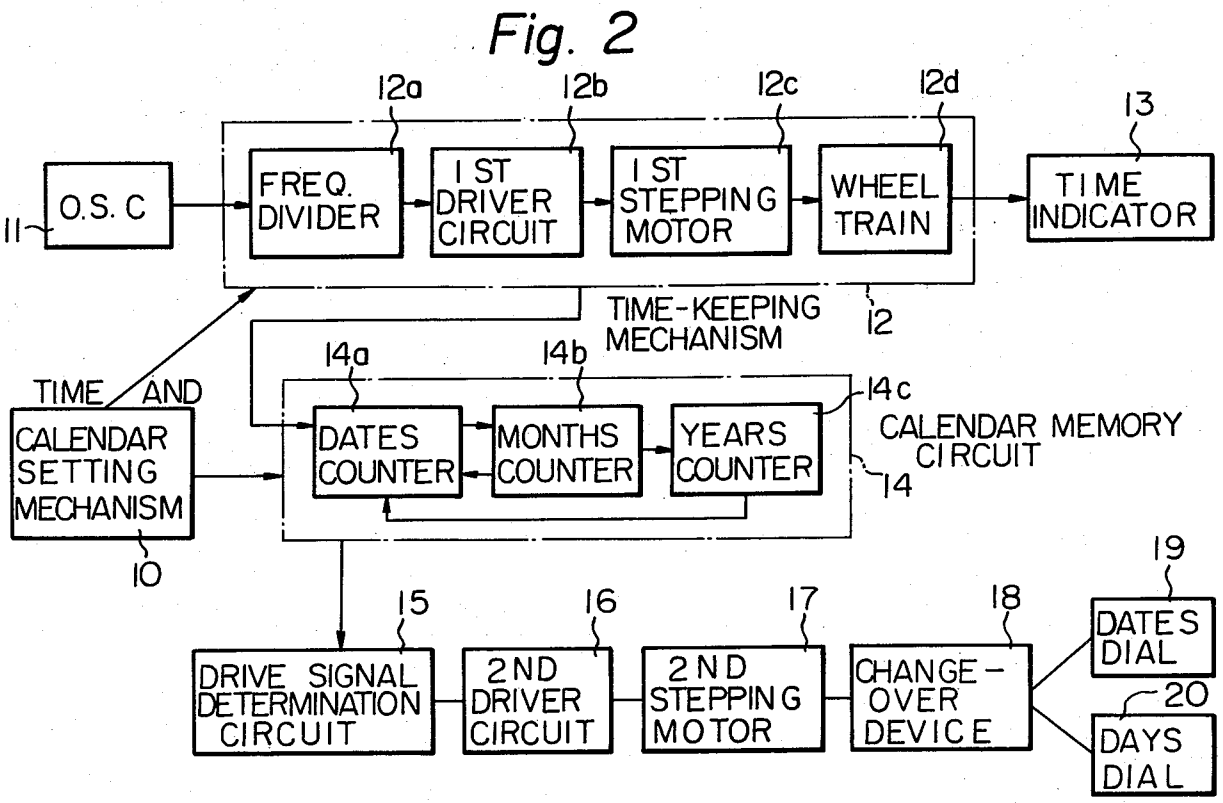
FIG. 2 is a block wiring diagram of a preferred embodiment of an electronic timepiece according to the present invention.

FIG. 2 depicts a block wiring diagram of a preferred embodiment of an electronic timepiece according to the invention. Designated at reference numeral 11 is a frequency standard composed of an oscillator for generating a relatively high frequency standard signal, and at 12 a time-keeping mechanism comprising a frequency divider 12*a*, a 1st driver circuit 12*b*, for driving the hands of the timepiece, a 1st driver means such as a stepping motor 12*c* which drives the hands of the timepiece, and an hours and minutes hand wheel train 12*d*. Designated at 13 is a time indicator (such as hours, minutes and seconds hands), and at 14 a calendar memory circuit comprising a dates counter 14*a*, months counter 14*b*, and years counter 14*c*. Reference numeral 15 denotes a motor drive signal determination circuit, 16 a 2nd driver circuit for driving the calendar display dials, 17 a second drive means such as a stepping motor which actually drives the calendar display dials, 18 a change-over device, 19 and 20 designate calendar display dials, namely a dates dial and days dial, and reference numeral 10 denotes a time and calendar setting mechanism for setting the time and calendar data.

In operation, a standard signal produced by oscillator 11, which may be crystal controlled, is coupled to the frequency divider 12*a* of the time-keeping mechanism 12 where it is divided and converted to a drive signal by motor drive circuit 12*b*, the drive signal thereafter being applied to 1st stepping motor 12*c* which is thus excited into driving the wheel train 12*d* the rotation of which increments the hours, minutes and seconds hands of the time indicator 13. On the other hand, a reference signal indicative of 00:00 AM, or midnight, is generated by the time-keeping mechanism 12 and supplied to the calendar memory circuit 14 of which the dates counter 14*a* is incremented accordingly. This in turn alters the content of months counter 14*b* and years counter 14*c* which will be incremented if it is the last day of the month or last day of the year, respectively. These changes in the content of calendar memory circuit 14 are coupled to motor drive signal determination circuit 15 which functions as a discriminator to determine whether the change in content is indicative of a mere change from one day to another, or from the last day of a month to the first day of the following month. Circuit 15 produces a date discrimination signal indicative of the dates to be incremented in response to the reference signal and thus increments the dates dial 19 and days dial 20 in a suitable fashion. This is accomplished by applying the dates discrimination signal to 2nd driver circuit 16 from which a drive signal is supplied to the calendar display dial drive motor or 2nd stepping motor 17 that is now rendered operative so as to drive the dates dial 19 and days dial 20 through the change-over device 18.

Figure 3:
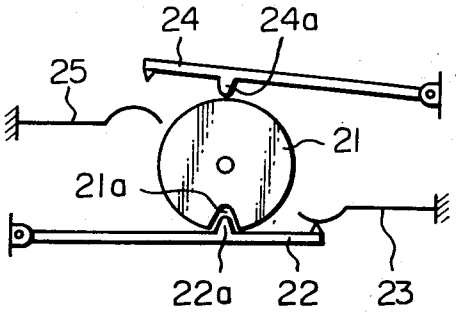
FIG. 3 is a side view showing the structure of a switch for generating, an electric signal.
Figure 4:
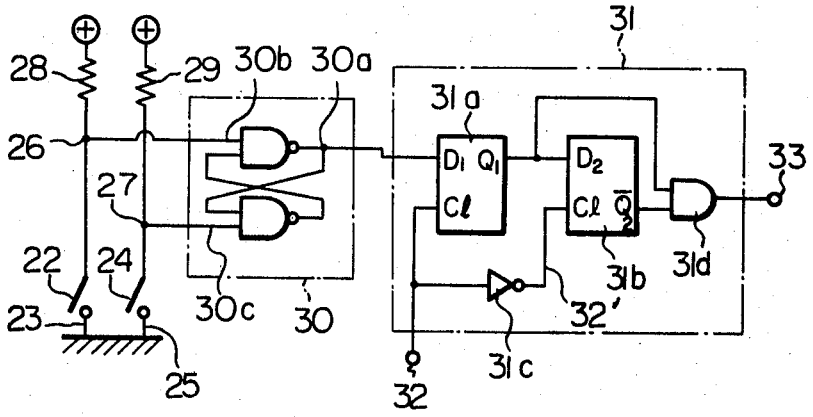
FIG. 4 is a wiring diagram of a circuit which produces a 00:00 AM signal using the switch shown in FIG. 3.
Figure 5:
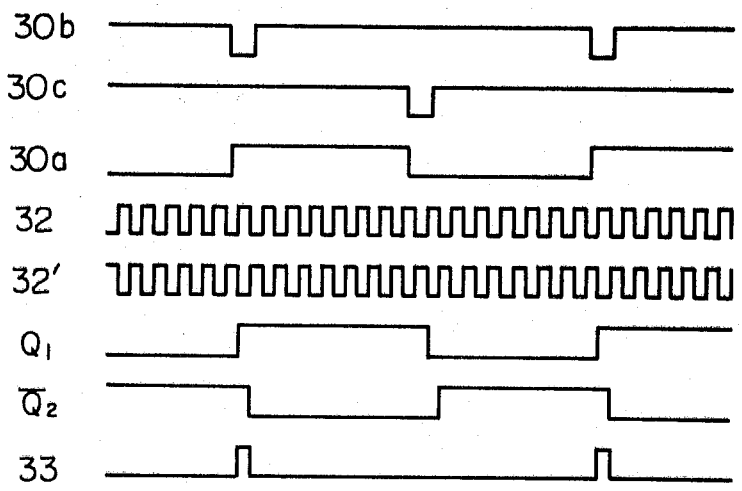
FIG. 5 is a timing chart of FIG. 2.

FIGS. 3, 4 and 5 relate to a preferred example for producing the reference signal using the wheel train 12*d* of the time-keeping mechanism 12. More specifically, FIG. 3 depicts the structure of a switch which allows an electric signal to be produced from the movement of the wheel train 12*d*. A cam 21 having a notch 21*a* that makes one complete revolution per day is connected to the wheel train 12*d*, and switches 22, 24 having respective projections 22*a*, 24*a* are disposed so that the projections may come into engagement with the notch 21*a*. Thus, when cam 21 has completed one revolution bringing its notch 21*a* into engagement with the projection 22*a* of switch 22, switch 22 is allowed to make contact with an input terminal 23 of a circuit which produces a 00:00 AM signal as the reference signal; in other words, switch 22 is allowed to close. On the other hand, switch 24 is closed when it is allowed to make contact with a circuit input terminal 25 because of the engagement between projection 24*a* and notch 21*a*.

FIG. 4 illustrates a circuit which produces the 00:00 AM signal through use of the input switches shown in FIG. 3. FIG. 5 depicts the relevant waveforms by means of a timing chart. Switches 22 and 24 possess the structures shown in FIG. 3, their input terminals 23, 25 being connected to the negative (−) side of a power source and nodes 26, 27 being connected to the positive (+) side of a power source across respective switching resistors 28, 29. Nodes 26 and 27 are connected to respective set and reset terminals 30*b*, 30*c* of an S-R (set-reset) type flip-flop circuit 30 which is composed of NAND gates in combination. A differentiation circuit 31 is connected to the output terminal 30*a* of the S-R flip-flop 30 and comprises a pair of data type flip-flops 31*a*, 31*b*, an inverter 31*c* and an AND gate 31*d*, a clock signal having a frequency such as 32 Hz, as tapped off the frequency divider 12*a* of FIG. 2, arriving at input terminal 32 of the differentiation circuit, while an output signal, namely the 00:00 AM signal, appears at its output terminal 33.

Using the timing chart of FIG. 5 to explain the circuit logic, the output which appears at output terminal 30*a* changes from an L (low) to an H (high) level when the set terminal 30*b* changes from an H to an L level; conversely, the output which appears at output terminal 30*a* changes from an H to an L level when the reset terminal 30*c* changes from an H to an L level. When both the set terminal 30*b* and reset terminal 30*c* attain an H level, output terminal 30*a* maintains its former state. Therefore, when switches 22 and 24 are turned ON and OFF, i.e., open and closed using the structure of FIG. 3, the signals which arrive at the input side of the flip-flop 30, that is, at the set terminal 30*b* and reset terminal 30*c*, assume the waveforms depicted in FIG. 5. A signal having a period of 1 day appears at output terminal 30*a* of the S-R flip-flop 30, as the chart shows. This signal along with the clock signal at terminal 32 is applied to D-type flip-flop 31*a* which produces an output signal Q1 that is coupled to flip-flop 31*b* along with the clock signal that has been inverted by inverter 31*c*, an output signal $\overline{Q}2$ appearing at the corresponding terminal of flip-flop 31*b*. These output signals Q1, $\overline{Q}2$ illustrated in FIG. 5 are applied to AND gate 31*d*, by which one pulse per day is generated as shown in the chart. In other words, if switch 22 is constructed so as to change from an H to an L level at 00:00 AM, the 00:00 AM signal can be produced in a highly reliable manner. Moreover, once a set input signal arrives at the S-R flip-flop 30, another set input signal cannot enter until a reset input signal has been received. This prevents erroneous operation of switches 22, 24 and permits synchronization with the frequency divider 12*a* of FIG. 2 so that the 00:00 AM signal can be obtained in a reliable fashion. It is also permissible to obtain the 00:00 AM signal directly from the frequency divider 12*a*.

Figure 6:
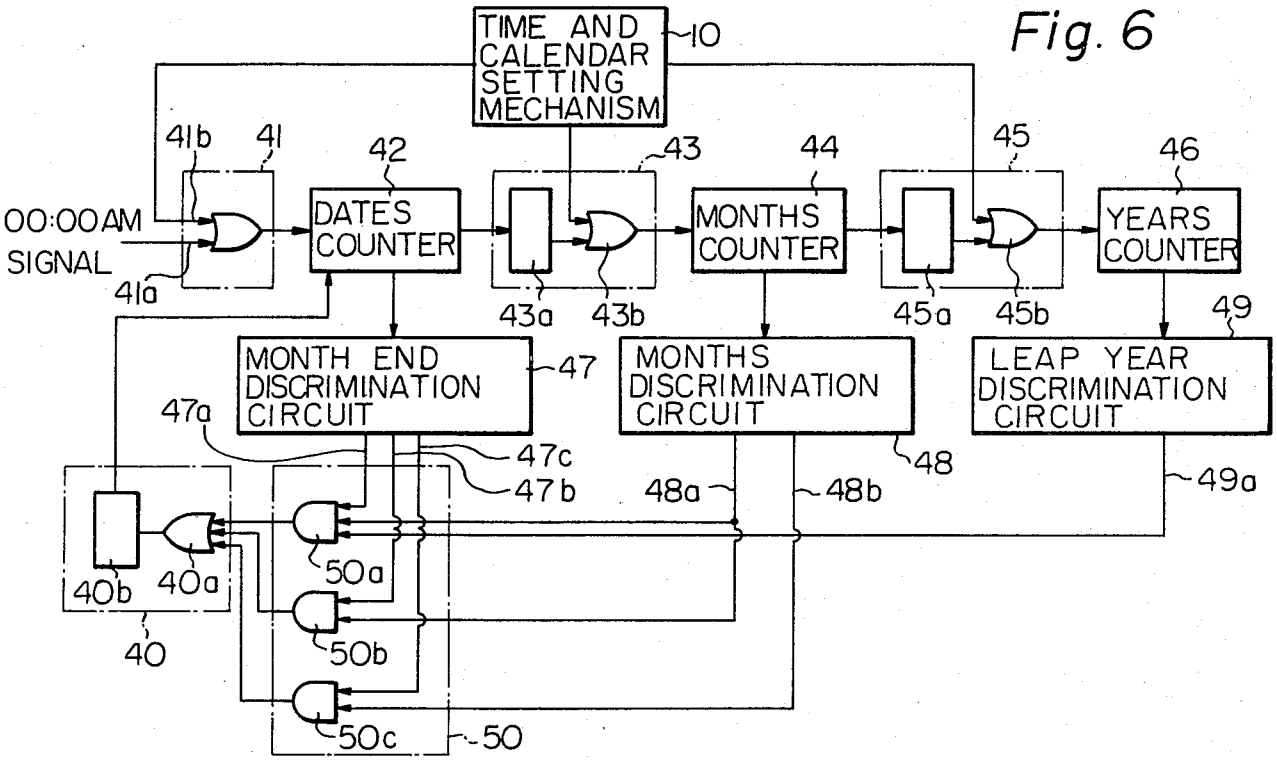
FIG. 6 is a block wiring diagram showing a preferred example of a calendar memory circuit of FIG. 2.

FIG. 6 is a block wiring diagram of the calendar memory circuit 14 shown in greater detail. A date-carry correction circuit 41 such as an OR gate receives the 00:00 AM signal at its one terminal 41*a*, while its another terminal 41*b* is connected to the time and calendar setting mechanism 10 and its output terminal to the input side of the dates counter 42. The correction circuit 41 is adapted to perform an addition operation for the dates counter 42 daily at 00:00 AM, and an addition operation on the dates that the dates counter 42 is initially set. Date counters 42 is a divide-by-31 counter of which one terminal is connected to the input terminal of a month-carry correction circuit 43, while the other terminal is connected to the input terminal of a month-end discrimination circuit 47 which detects whether a month possesses 29, 30 or 31 days. The set and reset terminals of the dates counter 42 are connected to the output terminals of a dates counter compensation circuit 40 the output of which sets the dates counter 42 to the first day of the month. The month-carry correction circuit 43 detects whether the content of dates counter 42 has changed over from the last day of a month to the first day of the following month, and performs a monthly addition operation for the month counter 44. To accomplish this, the correction circuit 43 is composed of a differentiation circuit 43*a* (which will be taken to mean a circuit that produces a pulse of a narrow width in response to detecting any change in an input signal) that generates a monthly addition pulse upon detecting the change-over from the last day to the first day of a month, and a circuit, such as the OR gate 43*b*, adapted to perform a months addition operation when the months counter 44 is initially set. Months counter 44 is a divide-by-12 counter of which one terminal is connected to the input terminal of a year-carry correction circuit 45, while the other terminal is connected to the input terminal of a months discrimination circuit 48 which detects the month of February or whether a month has 30 or 31 days. Year-carry correction circuit 45 detects whether the content of months counter 44 has changed over from December to January, and appropriately performs a yearly addition operation for the years counter 46. To accomplish this, the correction circuit 45 is composed of a differentiation circuit 45*a* that generates a yearly addition pulse upon detecting the change-over from December to January, and a circuit, such as OR gate 45, adapted to perform a years addition operation when the years counter 46 is initially set. The years counter 46 is connected to a leap year discrimination circuit 49 which detects whether the content of years counter 46 is an ordinary year or a leap year. Reference numeral 50 denotes a month-end compensation signal generator the input terminals of which are connected to the output terminals 47*a* (detection of a 29th-day), 47*b* (detection of a 30-day) and 47*c* (detection of a 31st-day) of month-end discrimination circuit 47, the output terminals 48*a* (detection of the month of February) and 48*b* (detection of a short month) of month discrimination circuit 48, and to the output terminal 49*a* (to detect ordinary years, for example) of leap year discrimination circuit 49. The month-end compensation signal generator comprises an AND gate 50*a* which supplies signals to dates counter compensation circuit 40, when, for example, February 29th of an ordinary year is detected, and AND gate 50*b* which supplies signals to dates counter compensation circuit 40 when the 30th of February is detected, and AND gate 50*c* which supplies signals to dates counter compensation circuit 40 when the 31st day of a 30-day month is detected. The input side of the date counter compensation circuit 40 is connected to the output terminals of the month-end compensation signal generator 50, the compensation circuit 40 being constructed of an adder 40*a* and a differentiating circuit 40*b*, and adapted to set the content of the dates counter 42 to the first day of the month by supplying the dates counter with a month-end compensation signal as instructed by the month-end compensation signal generator 50.

The calendar memory circuit illustrated in FIG. 6 operates as follows. If it is assumed that the content of the memory circuit is February 28 of an ordinary year, the arrival of a 00:00 AM signal at the day-carry correction circuit 41 will cause only the content of dates counter 42 to change to that indicative of a 29th day, whereby the content of the calendar memory circuit will become February 29 of an ordinary year; hence, the 29th day will be detected by the month-end discrimination circuit 47 which will then supply a signal to AND gate 50*a* of the month-end compensation signal generator 50. This signal will be coupled to date counter compensation circuit 40 since AND gate 50*a* will have already been opened by an earlier signal indicative of February of an ordinary year. The date counter compensation circuit 40 delivers a signal to the set and reset terminals of the dates counter 42 the content of which is thus changed from the 29th day to the 1st day. This transition is simultaneously transmitted to month-carry correction circuit 43 which produces an additional pulse for a month carry that is coupled to months counter 44 in order to bring its content to the month of March. In other words, the content of the calendar memory circuit undergoes a transition from February 28th of an ordinary year to March 1st of an ordinary year; the content will remain in this state until the next arrival of the 00:00 AM signal at the date-carry correction circuit 41.

In the embodiment illustrated in FIG. 6, a month-end compensation was accomplished by connecting the output of date counter compensation circuit 40 to the set and reset terminals of the date counter 42. However, modifications are possible, as shown in FIGS. 7 through 9.

Figures 7, 8:
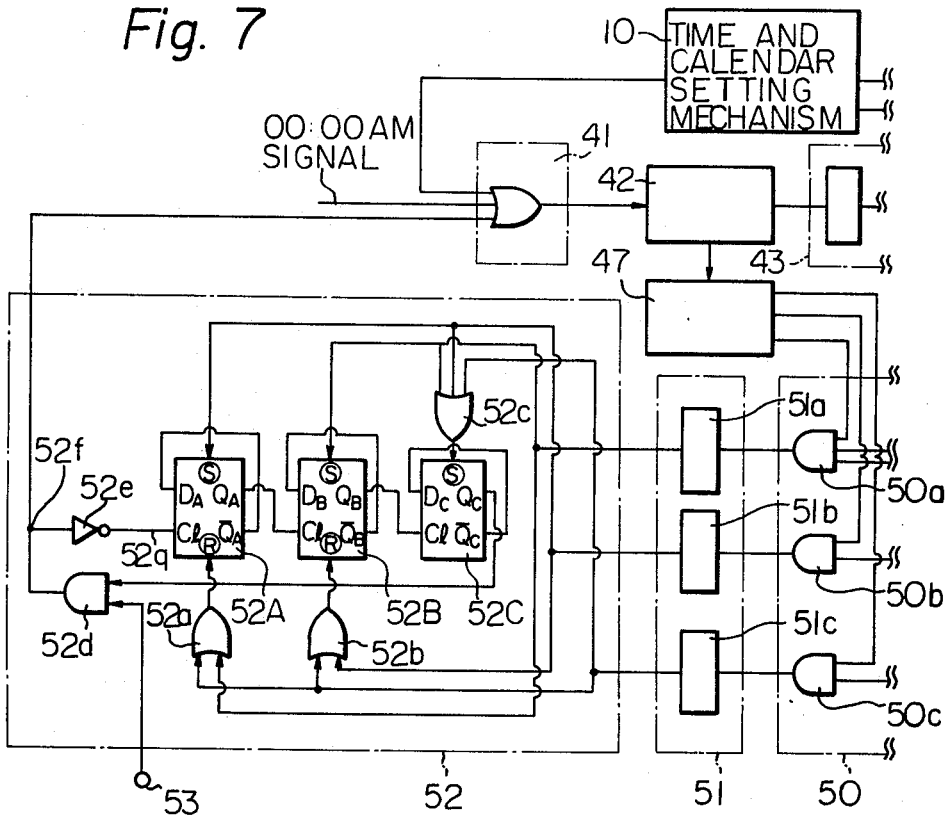
FIG. 7 is a circuit diagram illustrating another preferred example of the circuit shown in FIG. 6.
FIG. 8 is a truth table associated with the operation of D-type flip-flops of the circuit shown in FIG. 7.
Figures 9, 12:
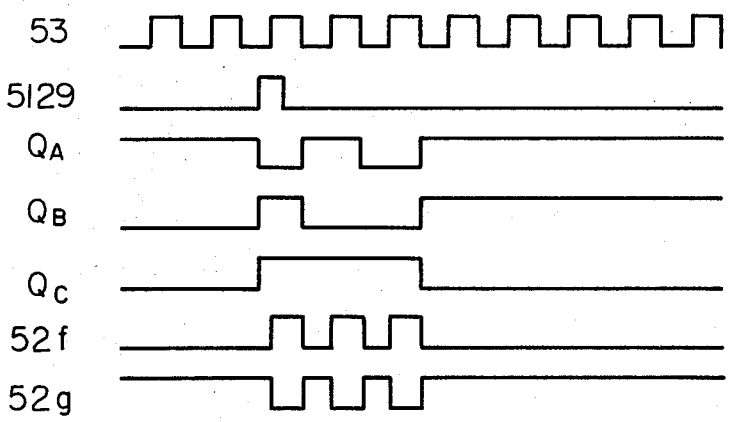
FIG. 9 is a timing chart associated with the circuit of FIG. 7.
FIG. 12 is a truth table associated with the operation of flip-flops of the circuit shown in FIG. 10.

FIG. 7 is a block wiring diagram showing a modification of the circuit shown in FIG. 6, FIG. 8 is a truth table which is useful in describing the operation of the D-type flip-flops illustrated in FIG. 7, and FIG. 9 is the associated timing chart. A differentiation circuit 51 which determines the initial state of date counter compensation adder 52 in response to the receipt of a signal from a month-end compensation signal generator 50 is composed of three circuits 51*a*, 51*b* and 51*c* each composed of two D-type flip-flops, and AND gate and an invertor. The date counter compensation adder 52 comprises three D-type flip-flops 52A, 52B, 52C, three OR gates 52*a*, 52*b*, 52*c*, and AND gate 52*d*, and an inverter 52*e*, the output terminal 52*f* being connected to the input terminal of a date-carry correction circuit 41. In addition, a clock signal having a frequency such as 64 Hz is tapped off a portion of the frequency divider 12*a* of the time-keeing mechanism 12 and is applied to the input terminal 53 of compensation adder 52.

In operation, a month-end compensation signal produced by the month-end compensation signal generator 50 is converted to spike-shaped pulse by differentiation circuit 51 which then couples the pulse to the set and reset terminals of the D-type flip-flops 52A, 52B, 52C in the month-end compensation adder 52, thereby determining the initial states at the QA, QB, QC terminals of the respective flip-flops. In this embodiment, the initial states which are set are denoted by 5129, 5130 and 5131 in FIG. 8 these three states representing the states that are established by the signals which appear at the respective portions 51*a*, 51*b*, 51*c* of the integration circuit 51. By way of example, a signal indicative of February 29th of an ordinary year which arrives at the AND gate 50*a* of month-end compensation signal generator 50 opens the gate, so that the signal is delivered to section 51*a* of the differentiation circuit 51. The signal which is formed in the differentiation circuit establishes the logic levels L, H, H, as indicated by 5129 in FIG. 8, at the respective terminals QA, QB, QC of flip-flops 52A, 52B, 52C in date counter compensation adder 52. As the timing chart for this operation shows, AND gate 52*d* opens only when the clock signal at terminal 53 attains an H level during an interval over which flip-flop 52C is also at an H level; hence, the clock signal is fed to the output terminal 52*f* during this interval, inverted by inverter 52*e* and applied to flip-flop 52A as the signal 52*g* in the timing chart. Thus, as the timing chart of FIG. 9 shows, the signal 52*g* is applied to output terminal 52*f* until the signal QC attains an L logic level; in all, three pulses are delivered to terminal 52*f*. The signal made up of these three pulses is coupled to date-carry correction circuit 41 so that the content of dates counter 42 is advanced from the 29th day to the 1st day. This transition is transmitted to month-carry correction circuit 43 which produces an additional pulse for a month carry so that the content of the calendar memory circuit becomes March 1 of an ordinary year. The content will remain in this state until the next arrival of the 00:00 AM signal at the date-carry correction circuit 41.

Figure 10:
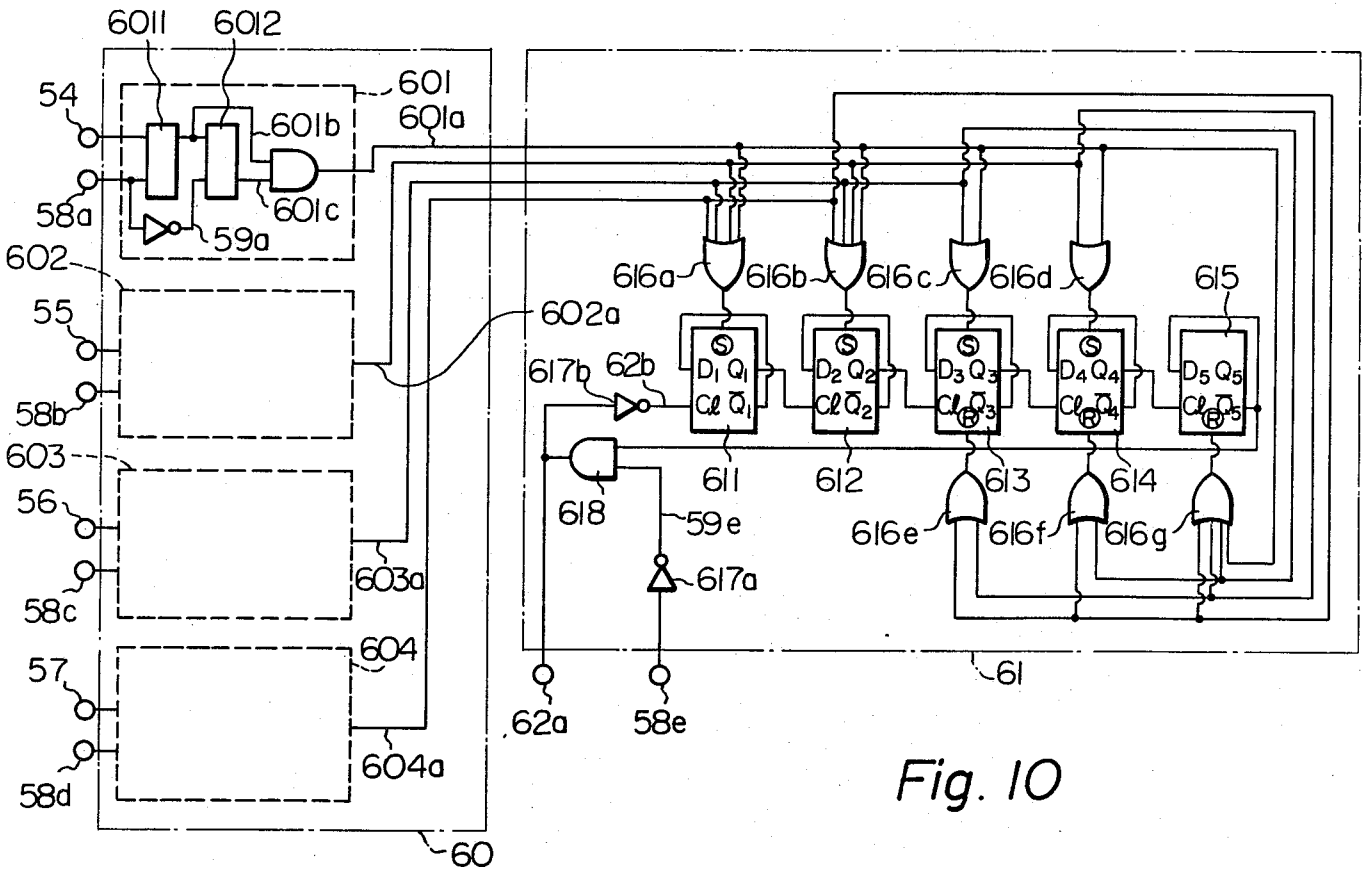
FIG. 10 is a block wiring diagram showing a preferred example of a motor drive signal determination circuit of FIG. 2.
Figure 11:
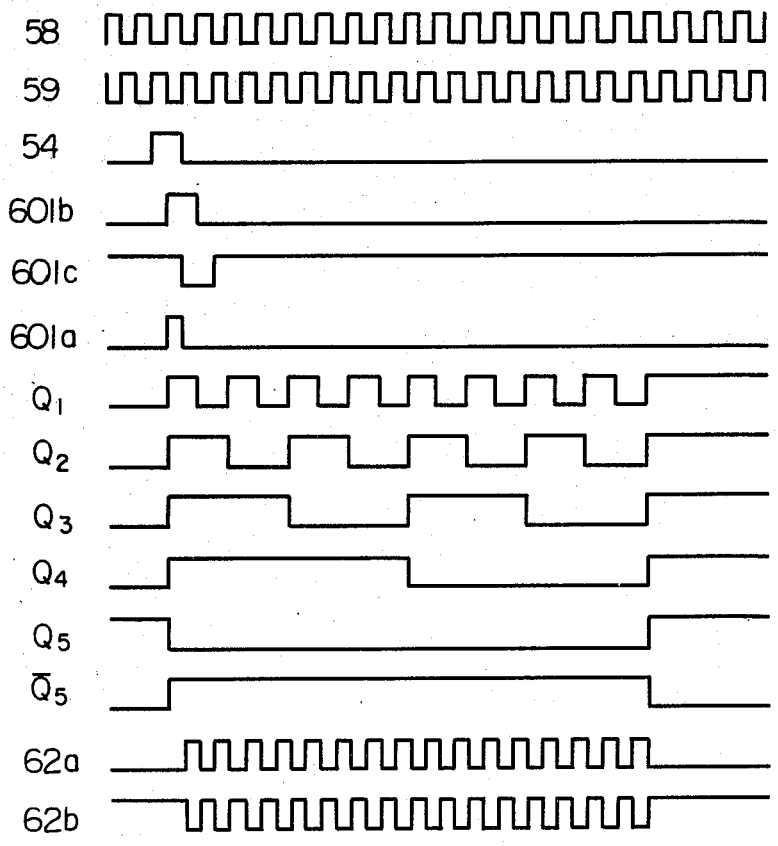
FIG. 11 is the associated timing chart for the circuit of FIG. 10.

FIG. 10 shows a preferred example of the motor drive signal determination circuit 15 depicted in FIG. 2, and FIG. 11 illustrates the associated timing chart. A differentiation circuit 60 receives as input signals the output signal produced by the month-end compensation signal generator 50 in the calendar memory circuit 14, and the 00:00 AM signal which arrives as long as said output signal from the generator 50 is absent. The differentiation circuit 60 narrows these signals into spike-like pulses and simultaneously assures that the pulses will be delivered to the motor drive signal generator 61 even if these signals vanish, this being accomplished by a construction which includes a circuit 601 rendered operative upon detection of February 29th of an ordinary year, a circuit 602 rendered operative upon detection of February 30th of a leap year, a circuit 603 rendered operative upon detection of a 31st day in a 30-day month, and a circuit 604 which is rendered operative upon detecting a daily 00:00 AM signal when none of the three above-mentioned conditions is satisfied. These circuits are identically constructed of, for example, two D-type flip-flops 6011, 6012, and inverter and an AND gate. The input terminals 54 through 57 of the differentiation circuit 60 receive, in respective order, a detection signal indicative of February 29th of an ordinary year, a signal indicative of February 30th of a leap year, a signal indicative of a 31st day in a 30-month, and a daily 00:00 AM signal which arrives when none of the above conditions is satisfied. Clock signal input terminals 58*a*, 58*b*, 58*c*, 58*d*, 58*e* are supplied with clock signal 58 (such as a 64 Hz signal, although not shown in FIG. 10) that is tapped off a portion of frequency divider 12*a* in the time-keeping mechanism 12. Differentiation circuit output terminals 601*a*, 602*a*, 603*a*, 604*a* are connected to the input sides of OR gates 616*a*, 616*b*, 616*c*, 616*d*, 616*e*, 616*f* and 616*g* of motor drive signal generator 60, the output terminals of the OR gates 616*a*, 616*b*, 616*c* and 616*d* being connected to the set terminals of D-type flip-flops 611, 612, 613 and 614. Similarly, the output terminals of the OR gates 616*e*, 616*f* and 616*g* are connected to reset terminals of flip-flops 613, 614 and 615. Two inverters 617*a*, 617*b* and an AND gate 618 complete the construction of the motor drive signal generator 61. Applied to one input terminal of AND gate 618 is an output signal $\overline{Q5}$ obtained from flip-flop 615, while the other input terminal receives a clock signal 59*e* which is the clock signal 58*e* after being inverted by the inverter 617*a*.

The operation of the motor drive signal determination circuit will now be described based upon the timing chart of FIG. 11. If, by way of example, the 29th day of February in an ordinary year is detected by AND gate 50*a* of the month-end compensation signal generator 50, the AND gate opens so that the signal indicative of this condition arrives at the input terminal 54 of the differentiation circuit 60. Flip-flops 6011, 6012 operate upon this signal under the influence of clock signal 58*a* and clock signal 59*a* so as to produce a spike-shaped pulse at the output side of the AND gate, as shown in FIG. 11. This pulsed signal is fed to five OR gates 616*a*, 616*b*, 616*c*, 616*d*, 616*g* which initially set the outputs Q1, Q2, Q3, Q4, Q5 of the five flip-flops to the logic levels indicated by 6029 in the truth table of FIG. 12. (The truth table shows the initial states of the outputs Q1, Q2, Q3, Q4, $\overline{Q5}$ for a case in which February 30th of a leap year is detected, as indicated by 6030, for a case in which the 31st day of a 30-day month is detected, as indicated by 6031, and for a case in which a daily 00:00 AM signal, that arrives when none of the above conditions are satisfied, is detected as indicated by 6032. These conditions may be more easily understood from the timing chart of FIG. 11. AND gate 618 is open only when clock signal 59*e* attains an H level during an interval over which the output $\overline{Q5}$ of flip-flop 615 is also at an H level; hence, during this interval the clock signal continues to arrive at the output terminal 62*a* of the motor drive signal circuit, is inverted by inverter 617*b* and applied to the clock terminal of flip-flop 611. As a result, the outputs Q1, Q2, Q3, Q4, $\overline{Q5}$ of flip-flops 611, 612, 613, 614, 615 are caused to change and assume the waveforms shown in FIG. 11. Thus, as the timing chart shows, the clock signal is applied to output terminal 62*a* until the output $\overline{Q5}$ of flip-flop 615 attains an L logic level; in all, 16 pulses are delivered to the terminal 62*a*. Thus, according to the motor drive signal determination circuit of the present embodiment as illustrated in FIG. 10, the signal which appears at output terminal 62*a* is formed to consist of 16 pulses when a signal arrives at input terminal 54, 12 pulses when a signal arrives at input terminal 55, 8 pulses when a signal arrives at input terminal 56, and 4 pulses when a signal arrives at input terminal 57. However, signals consisting of any number of pulses can easily be produced by increasing the number of flip-flops, changing the connections between the differentiation circuit and the set and reset terminals, etc.

Figure 13:
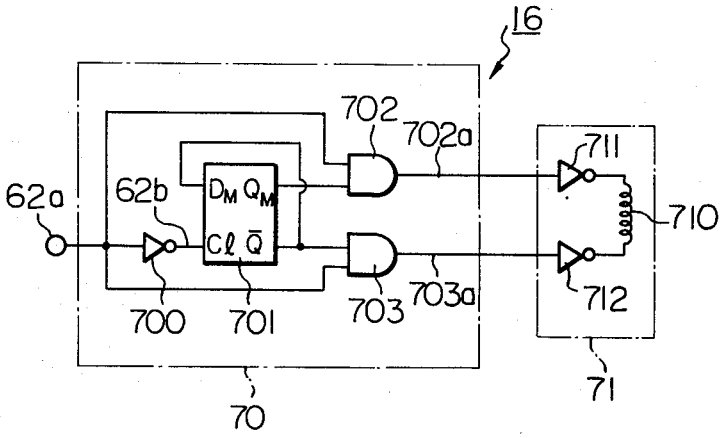
FIG. 13 is a circuit diagram showing a preferred example of a calendar display dial motor drive circuit of FIG. 2.
Figure 14:
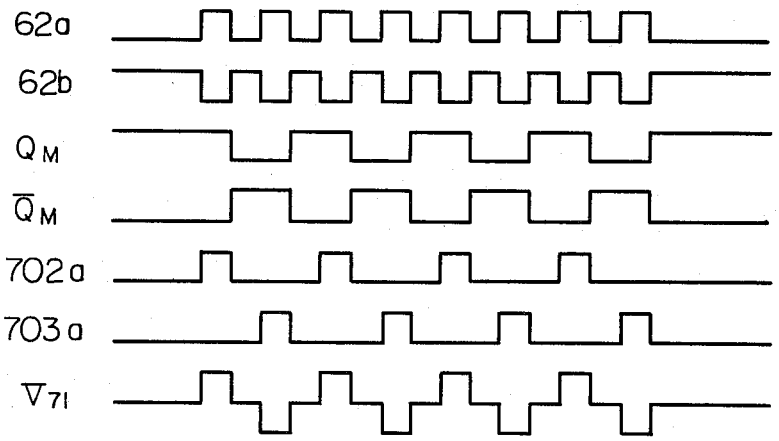
FIG. 14 is the associated timing chart for the circuit of FIG. 14.
Figure 15:
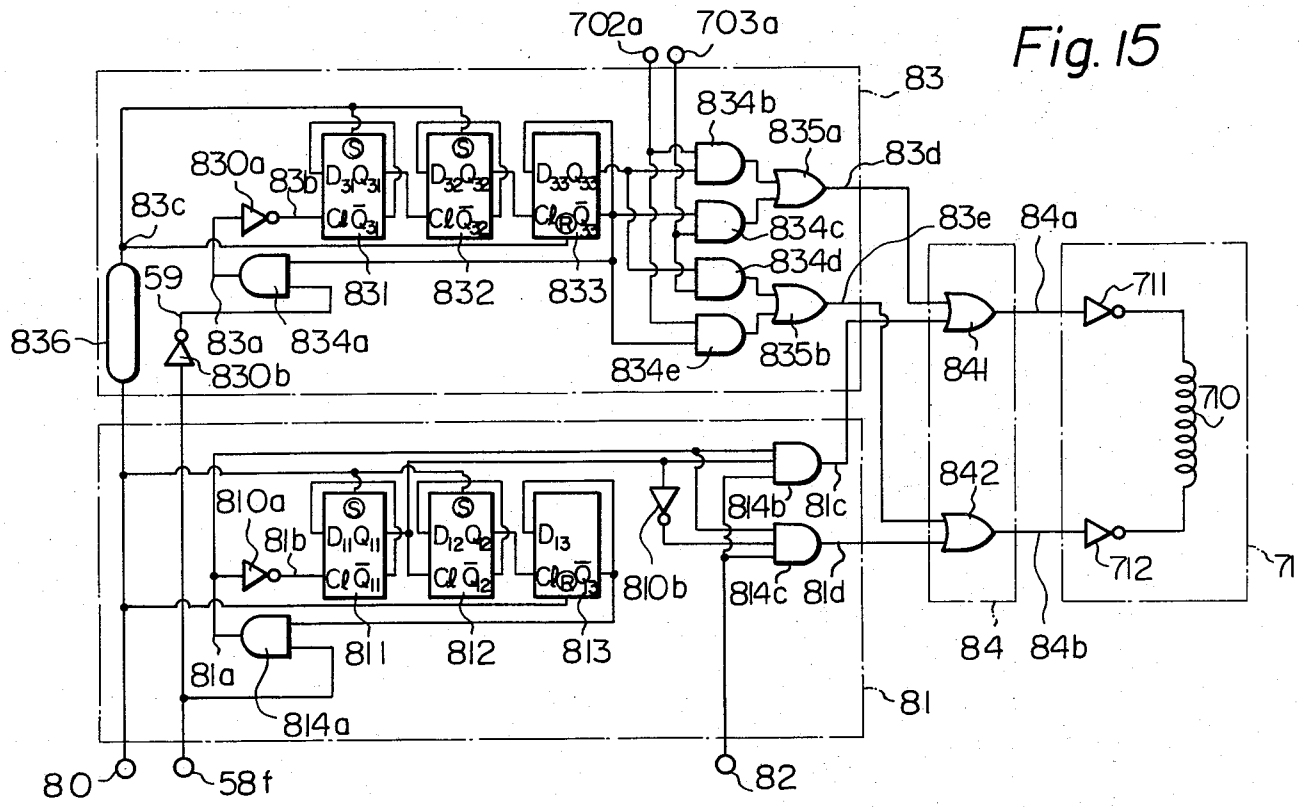
FIG. 15 is a circuit diagram showing another example of a calendar display dial motor drive circuit.
Figure 16A:
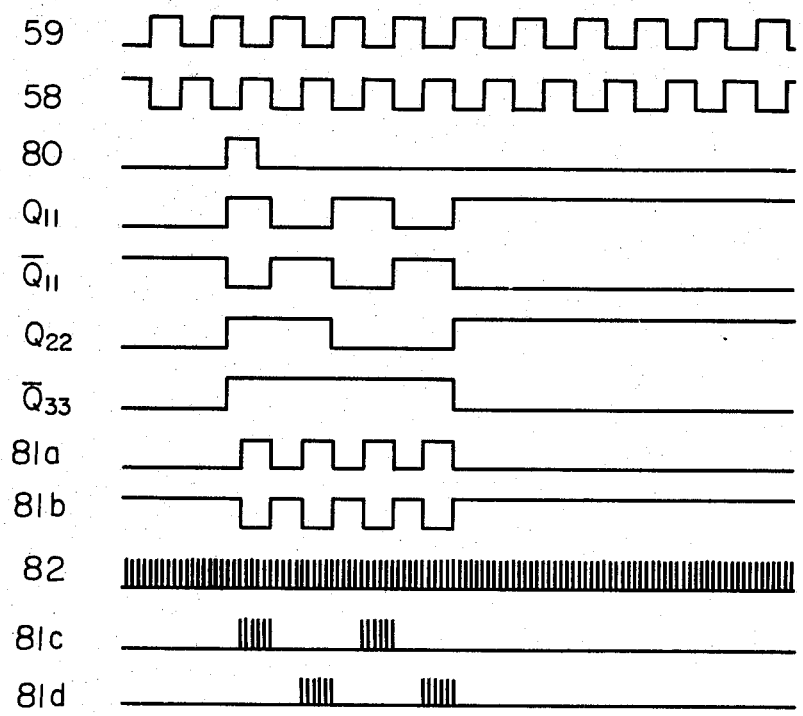
FIGS. 16A and 16B are the associated timing charts for the circuit of FIG. 15.
Figure 16B:
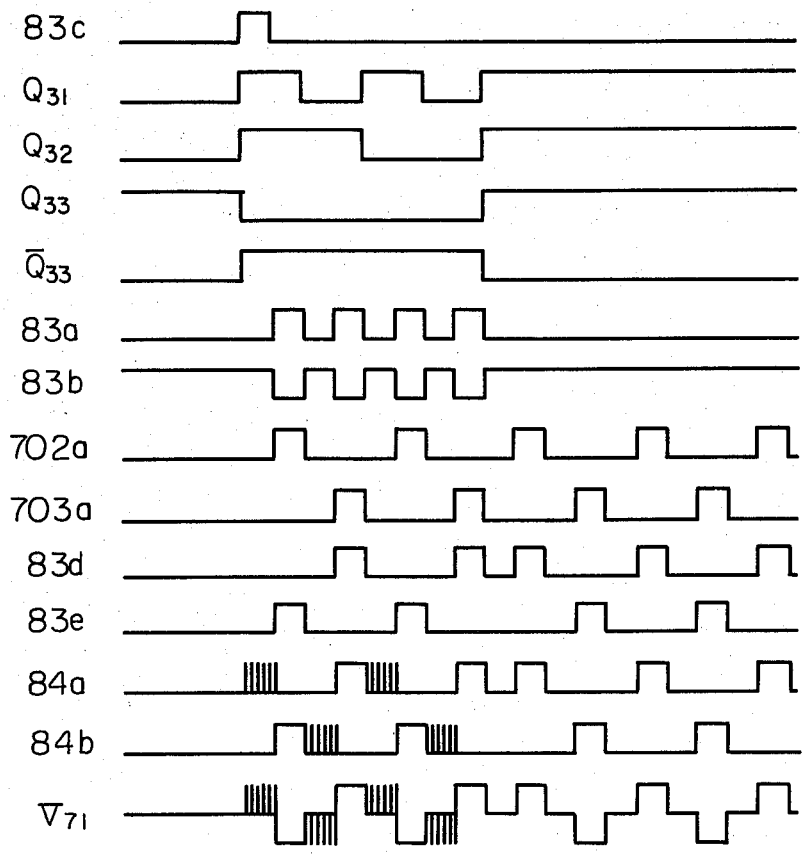
Figure 17:
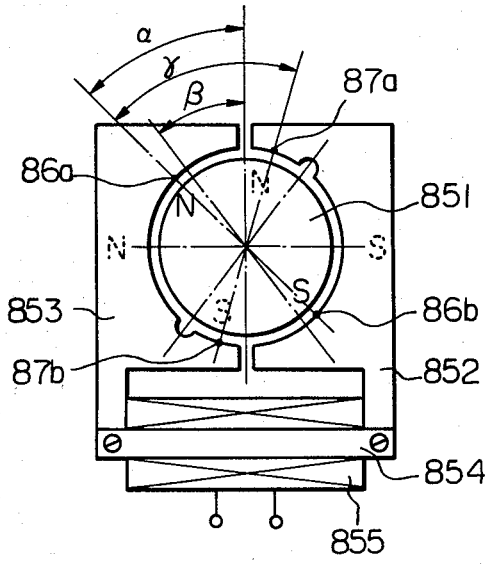
FIG. 17 is a plan view of a fixed direction stepping motor which is one embodiment of the calendar display dial drive motor shown in FIG. 2.

FIG. 13 illustrates an embodiment of the calendar display dial motor drive circuit 16 shown in FIG. 2, and FIG. 14 is the corresponding timing chart. FIG. 15 depicts another embodiment of the drive circuit, and FIG. 16 is the associated timing chart. FIG. 17 illustrates an example of the calendar display dial drive motor 17 of FIG. 2, the motor in this case being fixed direction stepping motor.

The calendar display dial motor drive circuit depicted in FIG. 13 makes use of the fixed direction rotation of the calendar display dial drive motor to drive the calendar display dials, such as the dates dial 19 and days dial 20, and comprises a wave shaping circuit 70 and motor drive circuit 71 in a case where the stepping motor of FIG. 17 is employed. Wave shaping circuit 70 comprises an inverter 700, D-type flip-flop 701 and two AND gates 702, 703, the input terminal 62*a* being connected to the output terminal, i.e., 62*a* in FIG. 10, of the motor drive signal circuit 15, and the two output terminals 702*a*, 703*a* being connected to the input terminals of respective inverters 711, 712 of the motor drive circuit 71. The motor for driving the calendar display dials will rotate when a current flows through the drive coil 710. With reference to the timing chart of FIG. 14, a signal which arrives at the input terminal 62*a* of the wave shaping circuit 70 is inverted by inverter 700 and divided in half by flip-flop 701, giving the two signals QM, $\overline{Q}$M. These two signals along with the input signal are applied to respective AND gates 702, 703, whereby the signals shown in FIG. 14 are produced at output terminals 702*a*, 703*a*. These signals are coupled to and current amplified by the two inverters 711, 712 of the motor drive circuit 71. When the outputs of the inverters arrive at the drive coil 710, a potential difference $V_{71}$ develops across the drive coil so as to rotate the motor for driving the calendar display dials.

The fixed direction stepping motor depicted in FIG. 17 comprises a rotor 851, stators 852, 853, driving coil 854, and a drive coil 855. Points of static equilibrium 86*a*, 86*b* are established by notches formed in the inner periphery of the stators. The equilibrium angle $\alpha$ is greater than the reversable angle of rotation $\beta$ so that rotation in the reverse, i.e., counter-clockwise, direction is not possible in this state; however, if a weak N-polorization is established in stator 853 and a weak S-polorization in stator 852 by passing a slight exciting current through drive coil 855, rotor 851 will rotate through an angle $\alpha$ and come to rest at electro-magnetic points of stable equilibrium 87*a*, 87*b*. Rotor 851 will begin to rotate in the reverse direction if the weak exciting current and the driving pulsed current of the opposite polarity are impressed upon the drive coil 855.

The calendar display dial motor drive circuit illustrated in FIG. 15 is an embodiment which will allow the motor to rotate in the reverse direction as well as in a fixed direction, this being accomplished by applying a high frequency voltage to the drive coil 855 so as to lower the average peak value of the impressed current, whereby the electro-magnetic points of stable equilibrium 87*a*, 87*b* are produced by virtue of this weak exciting current. The motor drive circuit comprises a high frequency biasing circuit 81, a wave shaping circuit 83 for reverse rotation, an adder 84 and a motor drive circuit 71. The high frequency biasing circuit 81 is composed of three D-type flip-flops 811, 812, 813, two inverters 810*a*, 810*b*, and three AND gates 814*a*, 814*b*, 814*c*, an input terminal 58*f* being supplied with a clock signal (not shown) such as may be tapped off a portion of frequency divider 12*a* in the time-keeping mechanism 12. An input terminal 80 connected to the set and reset terminals of flip-flops 811, 812, 813 is supplied with a 00:00 AM signal which is out of phase with the clock signal 58. In the present embodiment, the input terminal 80 sets the outputs Q11, Q12, $\overline{Q}$13 of these flip-flops to an H logic level. As the timing chart of FIG. 16 shows, AND gate 814*a* opens when the clock signal 58 is at an H level during an interval over which the output $\overline{Q}$13 of flip-flop 813 is also at an H level; hence, a signal consisting of 4 pulses is delivered to the output 81*a* of AND gate 814*a*. An input terminal 82 supplied with a high frequency pulsed signal as may be tapped off the frequency divider 12*a* of the time-keeping mechanism 12 is connected to the input terminals of AND gates 814*a*, 814*b*. High frequency biasing signals as shown in FIG. 16 will be obtained at the outputs 81*c*, 81*d* of the AND gates 814*b*, 814*c* when these AND gates are supplied with the outputs Q11 from flip-flop 811, 81*a* from AND gate 814*a* as well as the high frequency pulsed signal.

The wave shaping circuit 83 for reverse rotation comprises three D-type flip-flops 831, 832, 833, two inverters 830*a*, 830*b*, five AND gates 834*a*, 834*b*, 834*c*, 834*d* and 834*e*, two OR gates 835*a*, 835*b*, and a delay circuit 836. The 00:00 AM signal synchronized with the clock signal 58 by means of the delay circuit 836 is fed to the set and reset terminals of flip-flops 831, 832, 833 of which the outputs Q31, Q32, Q33 are set to respective H, H and L logic levels. During an interval over which the output Q33 of flip-flop 833 is at an H level, AND gate 834*a* opens when clock signal 59, which is clock signal 58 after inversion by inverter 830*b*, is also at an H logic level; hence, there appears at the output side 83*a* of AND gate 834*a* a signal consisting of four pulses which are delayed by one-half period with respect to the output 81*a* of AND gate 814*a* in the high frequency biasing circuit 81, the relevant waveforms being shown in FIG. 16. Input terminals 702*a*, 703*a* receive the output signals from the wave shaping circuit depicted in FIG. 13, these signals being illustrated in FIG. 16. The signals along with the outputs Q33, $\overline{Q}$33 of flip-flops 833 are operated upon by the AND gates 834*b*, 834*c*, 834*d*, 834*e* and OR gates 835*a*, 835*b* so as to produce the signals, shown in FIG. 16, at the outputs 83*d*, 83*e* of the OR gates.

Adder 84 comprises two OR gates 841, 842. By way of example, output 81*c* from the high frequency biasing circuit 81 and output 83*d* from wave shaping circuit 83 for reverse rotation are applied to the input terminal of OR gate 841, and output 81*d* from the high frequency biasing circuit 81 and output 83*e* from the wave shaping circuit 83 are applied to the input terminal of OR gate 842, whereby the signals shown in the time chart of FIG. 16B appear at the respective OR gate outputs 84*a*, 84*b*. These signals are applied to and current amplified by inverters 711, 712 of the motor drive circuit 71. When the outputs of the inverters are delivered to the drive coil 710, a potential difference $V_{71}$ develops across the ends of the coil, as shown in FIG. 16B. In the present embodiment, a weak exciting current is impressed 4 times, whereafter the driving pulses of the opposite polarity are applied 4 times, whereby the fixed direction stepping motor is rotated in the reverse, or counter-clockwise direction twice as instructed by the 4 pulses, whereafter the motor rotates in the clockwise direction. In the present embodiment, the motor has been adapted to rotate in the reverse direction twice; however, any number of reverse rotations can be obtained by increasing the number of flip-flop stages in the high frequency biasing circuit 81 or wave shaping circuit 83 for reverse rotation, and by changing the connections between the set and reset terminals and the input terminal 80 for the 00:00 AM signal. It is also possible to obtain any number of reverse rotations at the end of a month by connecting the outputs 601*a*, 602*a*, 603*a*, 604*a* of differentiation circuit 60, and not the 00:00 AM signal, to the set and reset terminals of the flip-flops in the high frequency biasing circuit 81 and wave shaping circuit 83.

Figure 18A:
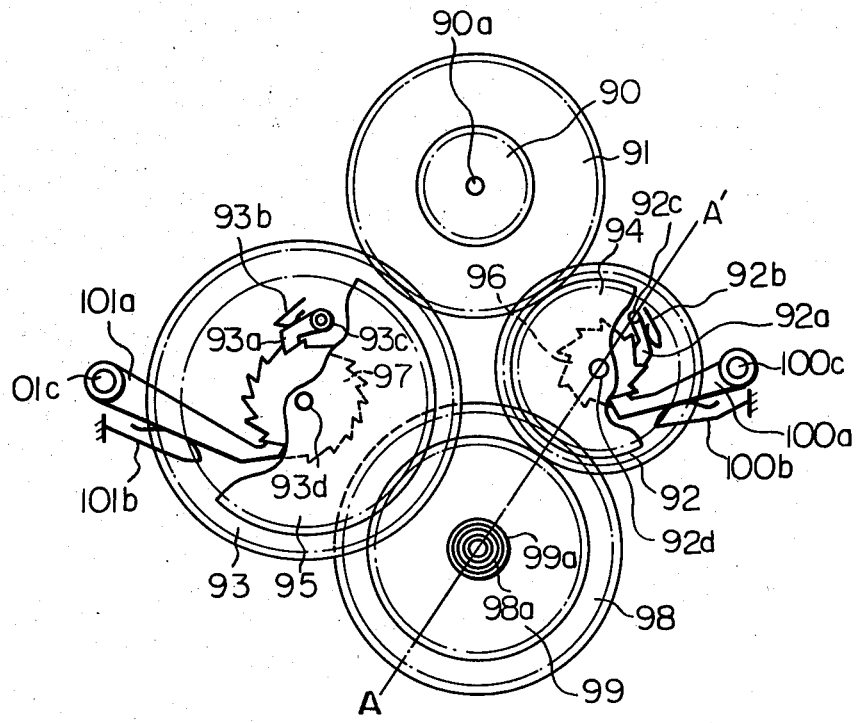
FIGS. 18A and 18B are respective plan and cross-sectional views of a preferred embodiment of a calendar drive device shown in FIG. 2.
Figure 18B:
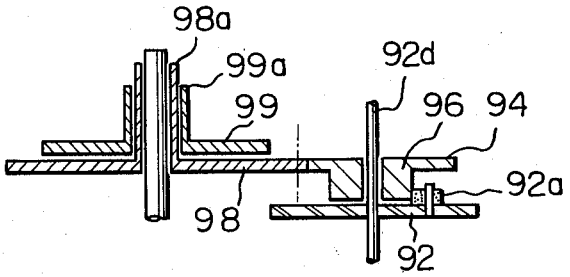

FIG. 18 depicts an embodiment of the change-over device 18 shown in FIG. 2. In a case where a reversable motor is employed as the motor to drive the calendar display dials, the change-over device comprises gears 90, 91, 92, 93, 94, 95, 98, 99, means for transmitting rotational motion depending on rotational direction, such as ratchet wheels 96, 97, pawls 92*a*, 93*a*, 100*a*, 101*a*, and springs 92*b*, 93*b*, 100*b*, and 101*b*. The rotational motion supplied by the motor for driving the calendar dials is transmitted to gear 90 by means of a shaft 90*a*. Gear 91 is coaxial with gear 90, rotates in phase and in the same direction with gear 90 and meshes with gears 92, 93. Gears 92 and 93 support respective pawls 92*a*, 93*a* that are adapted to pivot freely about pins 92*c*, 93*c*. Weak biasing springs 92*b*, 93*b* act to lightly hold the pawls 92*a*, 93*a* in engagement with the ratchet wheels 96, 97. Ratchet wheel 96 and gear 94, and ratchet wheel 97 and gear 95 define integrated structures adapted to rotate freely about their respective center axes 92*d*, 93*d*. Pawls 100*a* and 101*a* are held in engagement with ratchet wheels 96, 97 by springs 100*b*, 101*b*, the pawls 100*a*, 92*a* and 101*a*, 93*a* being mounted on different levels so as to preclude contact between them. If gear 90 is rotated in the clockwise direction, gear 91 will rotate gears 92, 93 in the counter-clockwise direction. Since pawl 93*a* is weakly biased against ratchet wheel 97, the tip of the pawl comes into engagement with a valley in ratchet wheel 97, and the rotation of gear 93 is transmitted to gear 95 which rotate gear 99 in the clockwise direction. On the other hand, although pawl 92*a* is lightly biased against ratchet 96 by spring 92*c*, the rotation of gear 92 cannot be transmitted to gear 94, and pawl 92*a* slides over the outer periphery of ratchet 96. Likewise, when gear 90 is rotated in the counter-clockwise direction, gear 91 will rotate gears 92, 93 in the clockwise direction, and the rotation of gear 92 will bring the tip of pawl 92*a* into engagement with a valley in ratchet 96, thereby rotating gear 94 which in turn rotates gear 98 in the counter-clockwise direction. In this case, the rotation of gear 93 will not be transmitted to gear 95 since the pawl 93*a* slides over the outer periphery of ratchet 97. Accordingly, if the calendar display dials such as the dates and days dials are attached to the shaft ends 98*a*, 99*a* of the respective gears 98, 99, the rotational direction of the gear 90 can be used to advance the display dials independently. For example, by using the motor drive circuit which drives the calendar display dials, reverse or counter-clockwise rotation can be used to advance the days dial, and clockwise rotation can be used to advance the dates dial.

In a case where a fixed direction motor is used as the calendar display dial drive motor, the motor may be used to advance only the dates dial, or the calendar display dials such as the dates and days dials can be advanced by a change-over in the driving method.

A motor which has a large torque but low efficiency may be used as the calendar display dial drive motor, and a motor which has a small torque but high efficiency may be used as the motor 12*c* which drives the hands of the timepiece. In this case, calendar display dials can be driven with ease. Since, further, the motor for driving the hands has a high efficiency, overall timepiece power consumption can be reduced, and timepiece size can be reduced. Moreover, if a current is not allowed to flow simultaneously through the calendar display dial drive motor and the motor for driving the hands of the timepiece, it is possible to prevent a drop in battery voltage caused by an increase in internal resistance that accompanies a temperature drop; at the same time, erroneous circuit and motor operation can be prevented. It is therefore possible to utilize a battery with a small capacity.

Thus, in accordance with the invention as illustrated in the block diagram of FIG. 2, a driving system is divided between a time indicator and calendar display dials. Accordingly, it is no longer neccessary to manually advance, by means of a crown or the like, the calendar display dials, particularly the date dial, even on the last day of a short month. By combining this system with that of an electronic timepiece, it suffices to set the calendar display dials just once in order to permanently establish correct calendar information as long as the battery is not removed. It is thus possible to obtain an electronic timepiece with the same external features as that of the conventional type in which it was necessary to adjust the calendar dials once a month or once a year, whereas in the present invention the calendar display dials are automatically advanced immediately after 00:00 AM.

What is claimed is:

1. An electronic timepiece having time indicating hands and a calendar display, comprising:

a frequency standard providing a relatively high frequency signal;

a timekeeping mechanism composed of a frequency divider circuit for providing time information signals, first driver circuit means responsive to said time information signals for providing first drive signals indicative of time information, first motor means driven in response to said first drive signals, and a wheel train connected to said first drive motor means to actuate said time indicating hands to display said time information including at least hours and minutes information;

a source of a clock signal;

means for generating a daily reference signal at least once per day, which comprises switch means responsive to the movement of the wheel train for providing a switching signal, and a 00:00 AM signal producing circuit including circuit means responsive to said switching signal for producing an output signal and a differentiation circuit responsive to said output signal from said circuit means and said clock signal for generating said daily reference signal which is a 00:00 AM signal indicative of midnight;

calendar memory circuit means responsive to said daily reference signal for memorizing calendar information and providing output signals indicative of said calendar information, said calendar information including respective actual month end information of every month, said calendar memory circuit means comprising a dates counter responsive to said daily reference signal for counting the days in each month and for producing a month end signal indicative of the end of each month, when a predetermined number of days has been counted therein, a month counter responsive to said month end signal for counting the months in each year and for producing a year end signal indicative of the end of each year, when twelve months have been counted, a year counter responsive to said year end signal for counting years, a month end discrimination circuit responsive to the contents of said dates counter for detecting a plurality of predetermined counts of numbers of days and for producing output signals indicative thereof, a months discrimination circuit responsive to the contents of said months counter for detecting a plurality of predetermined counts of numbers of months, and for producing output signals indicative thereof, a leap year discrimination circuit responsive to the contents of said year counter for detecting leap year and for producing output signals indicative thereof, month end compensation signal generator means responsive to the output signals from said month end discrimination circuit, months discrimination circuit and leap year discrimination circuit for producing said calendar information output signals to be applied to said drive signal determination means, and date counter compensation circuit means responsive to said calendar information output signals from said month end compensation signal generator means for producing a dates counter compensation signal, said dates counter compensation signal being applied to said dates counter for automatically correcting the contents thereof at least the end of each month;

drive signal determination circuit means responsive to said daily reference signal and said output signals from said calendar memory circuit means for producing a date discrimination signal, said date discrimination signal including month end correction information;

second driver circuit means responsive to said date discrimination signal to provide second drive signals indicative of calendar information;

second drive motor means comprising a stepping motor coupled to receive said second drive signals; and a dates dial coupled to said stepping motor for displaying the respective actual month end of every month.

2. An electronic timepiece having time indicating hands and calendar display, comprising:

a frequency standard providing a relatively high frequency signal;

a timekeeping mechanism composed of a frequency divider circuit for providing time information signals, first driver circuit means responsive to said time information signals for providing first drive signals indicative of time information, first drive motor means driven in response to said first drive signals, and a wheel train connected to said first drive motor means to actuate said time indicating hands to display said time information including at least hours and minutes information;

a source of a clock signal;

means for generating a daily reference signal at least once per day, which comprises switch means responsive to the movement of said wheel train for providing a switching signal, and a 00:00 AM signal producing circuit including circuit means responsive to said switching signal for producing an output signal and a differentiation circuit responsive to said output signal from said circuit means and said clock signal for generating said daily reference signal which is a 00:00 AM signal indicative of midnight;

calendar memory circuit means responsive to said daily reference signal for memorizing calendar information and providing output signals indicative of said calendar information, said calendar information including respective actual month end information of every month, said calendar memory circuit means comprising a date counter responsive to said daily reference signal for counting the days in each month and for producing a month end signal indicative of the end of each month, when a predetermined number of days has been counted therein, a month counter responsive to said month end signal for counting the months in each year and for producing a year end signal indicative of the end of each year, when twelve months have been counted, a year counter responsive to said year end signal for counting years, a month end discrimination circuit responsive to the contents of said dates counter for detecting a plurality of predetermined counts of numbers of days and for producing output signals indicative thereof, a months discrimination circuit responsive to the contents of said months counter for detecting a plurality of predetermined counts of numbers of months, and for producing output signals indicative thereof, a leap year discrimination circuit responsive to the contents of said years counter for detecting leap years and for producing output signals indicative thereof, month end compensation signal generator means responsive to the output signals from said month end discrimination circuit, months discrimination circuit and leap year discrimination circuit for producing said calendar information output signals to be applied to said drive signal determination means, and date counter compensation circuit means responsive to said calendar information output signals from said month end compensation signal generator means for producing a date counter compensation signal, said dates counter compensation signal being applied to said dates counter for automatically correcting the contents thereof at least the end of each month;

drive signal determination circuit means responsive to said daily reference signal and said output signals from said calendar memory circuit means for producing a date discrimination signal, said date discrimination signal including month end correction information;

a source of a high frequency pulsed signal;

second driver circuit means comprising a high frequency biasing circuit responsive to said daily reference signal, clock signal and high frequency pulsed signal for providing high frequency biasing signals, a first wave shaping circuit responsive to said date discrimination signal for providing pulse signals, a second wave shaping circuit responsive to said daily reference signal, clock signal and pulse signals for providing output signals, an adder circuit responsive to said high frequency biasing signals and said output signal from said second wave shaping circuit for providing output signals, and a motor drive circuit responsive to said output signals from said adder circuit for providing second drive signals indicative of calendar information;

second drive motor means comprising a reversible stepping motor operative to rotate in first and second directions of rotation in respect to said second drive signals;

a change-over device driven by said reversible stepping motor to selectively transmit power from said reversible stepping motor through a first transmission path and a second transmission path in response to rotation of said reversible stepping motor in said first and second directions of rotation respectively;

a dates dial for displaying the respective actual month end of every month, said dates dial being driven by said reversible stepping motor through said first transmission path; and a days dial for displaying said calendar information, said days dial being driven by said reversible stepping motor through said second transmission path.

3. An electronic timepiece according to claim 2, in which said high frequency biasing circuit comprises counter circuit means and gate means coupled to receive said clock signal and said high frequency signal, said counter circuit means being responsive to said 00:00 AM signal for enabling said gate means, whereby said high frequency biasing signals are provided from said gate means for enabling said second drive motor means to rotate in a reverse direction.

4. An electronic timepiece according to claim 2, in which said second wave shaping circuit comprises counter circuit means and gate means coupled to receive said pulse signals from said first wave shaping circuit, said counter circuit means being responsive to said 00:00 AM signal to allow said gate means to provide output signals for driving said second drive motor means in said first and second directions.

5. An electronic timepiece having time indicating hands and calendar display means, comprising:

a frequency standard providing a relatively high frequency signal;

a timekeeping mechanism composed of a frequency divider responsive to said relatively high frequency signal for providing time information signals, first driver circuit mens responsive to said time information signals for providing first drive signals, first drive motor means driven in response to said first drive signals, and a gear wheel train connected to said first drive motor means to actuate said time indicating hands to display said time information, said time information including at least hours and minutes information;

means coupled to said timekeeping mechanism for generating a daily reference signal at least once per day;

calendar memory circuit means responsive to said daily reference signal for memorizing calendar information and providing output signals indicative of said calendar information, said calendar information including respective actual month information of every month, said calendar memory circuit means comprising a dates counter responsive to said daily reference signal for counting the days in each month and for producing a month end signal indicative of the end of each month, when a predetermined number of days has been counted therein, a months counter responsive to said month end signal for counting the months in each year and for producing a year end signal indicative of the end of each year, when twelve months have been counted, a year counter responsive to said year end signal for counting years, a month end discrimination circuit responsive to the contents of said dates counter for detecting a plurality of predetermined counts of numbers of days and for producing output signals indicative thereof, a months discrimination circuit responsive to the contents of said months counter for detecting a plurality of predetermined counts of numbers of months, and for producing output signals indicative thereof, a leap year discrimination circuit responsive to the contents of said years counter for detecting leap years and for producing output signals indicative thereof, month end compensation signal generator means responsive to the output signals from said month end discrimination circuit, months discrimination circuit and leap year discrimination circuit for producing said calendar information output signals to be applied to said drive signal determination means, and date counter compensation circuit means responsive to said calendar information output signals from said month end compensation signal generator means for producing a dates counter compensation signal, said dates counter compensation signal being applied to said dates counter for automatically correcting the contents thereof at least the end of each month;

drive signal determination circuit means responsive to said daily reference signal and said output signals from said calendar memory circuit means for producing a date discrimination signal, said date discrimination signal including month end correction information, said drive signal determination circuit means comprising counter circuit means responsive to said output signals from said calendar memory circuit means for being preset to an initial count value, and gate means coupled to receive said clock signal and controlled by said counter circuit means, whereby said date discrimination signal is produced from said gate means as a group of consecutive pulses subsequent to presetting of said counter circuit means to said initial count value, with the number of pulses in said date discrimination signal constituting said month end correction information;

second drive circuit means responsive to said date discrimination signal for providing second drive signals indicative of calendar information;

second drive motor means coupled to receive said second drive signals; and a calendar information display comprising at least a dates dial coupled to said second drive motor means to be advanced thereby, whereby month end display by said calendar information display is automatically corrected and the respective actual month end of every month are automatically displayed.

* * * * *